United States Patent [19]

Baynes et al.

[11] 4,278,250

[45] Jul. 14, 1981

[54] GYMNASIUM SET

[75] Inventors: William R. Baynes, DuQuoin; Donal D. Hock, Herrin, both of Ill.

[73] Assignee: Turco Manufacturing Co., DuQuoin, Ill.

[21] Appl. No.: 65,922

[22] Filed: Aug. 13, 1979

[51] Int. Cl.[3] ..... A63B 9/00; A63G 9/00

[52] U.S. Cl. ..... 272/113; 272/85; 272/111; 272/112

[58] Field of Search ..... 272/85, 109, 111, 115, 272/113, 61-63, 112; D21/241-246

[56] References Cited

U.S. PATENT DOCUMENTS

| | | | |
|---|---|---|---|
| D. 135,935 | 7/1943 | Miller | 272/113 X |
| D. 178,663 | 9/1956 | Horowitz | D21/245 |
| D. 180,402 | 6/1957 | Harris | D21/245 X |
| D. 222,487 | 10/1971 | Korte | D21/245 |
| D. 249,080 | 8/1978 | West | D21/244 |
| 1,126,082 | 1/1915 | Reach | 272/113 X |
| 1,975,463 | 10/1934 | Jones | 272/85 |
| 2,929,627 | 3/1960 | Scanlon | 272/112 |
| 3,547,435 | 12/1970 | Scott | 272/113 X |
| 3,601,397 | 8/1971 | Carlin | 272/85 X |
| 3,719,358 | 3/1973 | Aaron | 272/113 |
| 3,850,428 | 11/1974 | Zuber | 272/113 |
| 4,084,812 | 4/1978 | Melrose et al. | 272/85 |

FOREIGN PATENT DOCUMENTS

| | | | |
|---|---|---|---|
| 290629 | 8/1928 | United Kingdom | 272/113 |
| 680928 | 10/1952 | United Kingdom | 272/113 |
| 1229575 | 4/1971 | United Kingdom | 272/113 |
| 1229791 | 4/1971 | United Kingdom | 272/85 |
| 1405885 | 9/1975 | United Kingdom | 272/85 |

*Primary Examiner*—Richard J. Apley

*Attorney, Agent, or Firm*—Rogers, Eilers & Howell

[57] ABSTRACT

A first horizontally-directed spacing and connecting member extends between and interconnects the upper ends of a first plurality of aligned, but spaced-apart, vertically-directed columns, a second horizontally-directed spacing and connecting member extends between and interconnects an intermediate portion of one of the first plurality of vertically-directed columns with the upper ends of two columns of a second plurality of vertically-directed columns, a third horizontally-directed spacing and connecting member extends between and interconnects an intermediate part of a second of the first plurality of vertically-directed columns with the upper ends of two columns of the second plurality of vertically-directed columns, and rung-like spacers interconnect the second and third horizontally-directed spacing and connecting members to constitute an overhead exercise ladder. The first plurality of vertically-directed columns includes at least three columns, the second plurality of vertically-directed columns also includes at least three columns and the three horizontally-directed spacing and connecting members act to stabilize and stiffen all of the columns of the first plurality and second plurality of columns.

1 Claim, 1 Drawing Figure

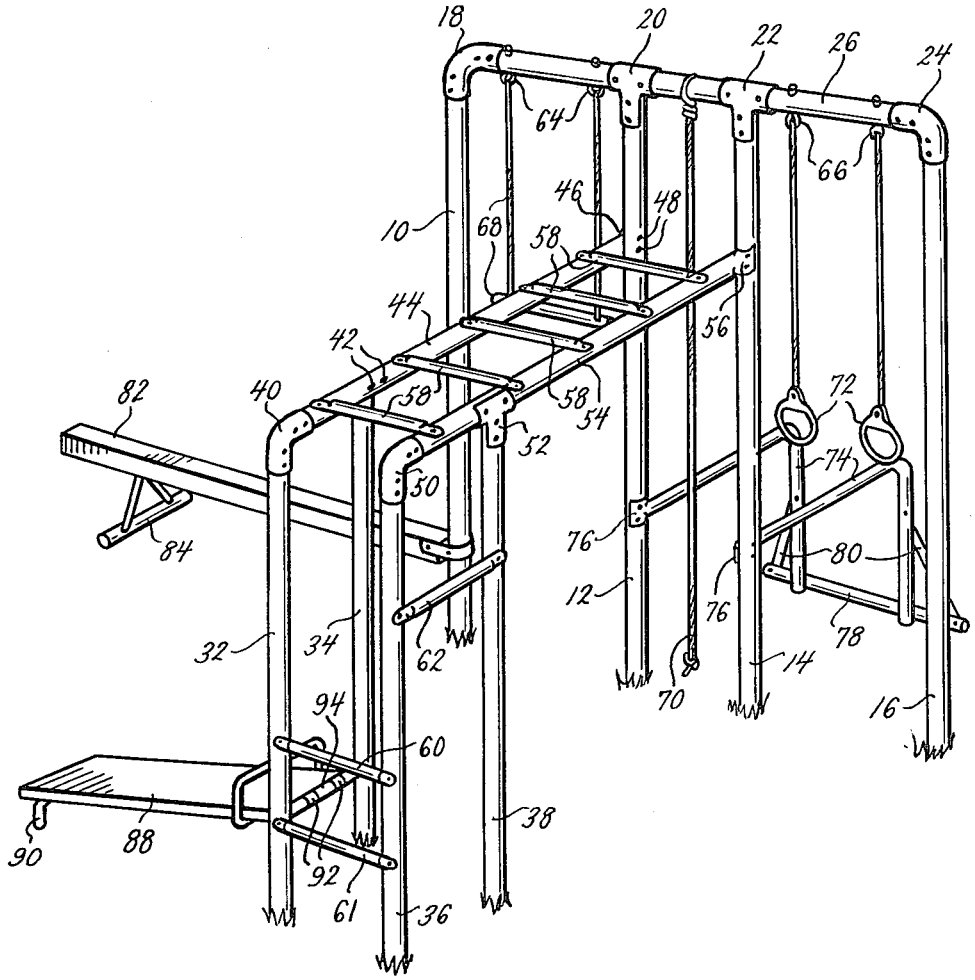
18
20
22
26
24
64
66
10
68
46
48
58
44
56
42
40
58
58
54
82
52
72
50
74
84
76
80
12
76
78
32
34
62
14
70
16
94
60
38
90
88
92
61
36

GYMNASIUM SET

FIELD OF THE INVENTION

Gymnasium sets, which include a plurality of vertically-directed columns and which also include horizontally-directed spacing and connecting members, provide opportunities for various forms of athletic exercise and activity. The present invention provides an improved gymnasium set which includes vertically-directed columns and also provides horizontally-directed spacing and connecting members.

SUMMARY OF THE INVENTION

The gymnasium set provided by the present invention has a first horizontally-directed spacing and connecting member which extends between and interconnects the upper ends of a first plurality of aligned, but spaced-apart, vertically-directed columns, has a second horizontally-directed spacing and connecting member which extends between and interconnects an intermediate portion of one of the first plurality of vertically-directed columns with the upper ends of two columns of a second plurality of vertically-directed columns, has a third horizontally-directed spacing and connecting member which extends between and interconnects an intermediate part of a second of the first plurality of vertically-directed columns with the upper ends of two columns of the second plurality of vertically-directed columns, and has rung-like spacers which interconnect the second and third horizontally-directed spacing and connecting members to constitute an overhead exercise ladder. The first plurality of vertically-directed columns includes at least three columns, the second plurality of vertically-directed columns also includes at least three columns, and the three horizontally-directed spacing and connecting members act to stabilize and stiffen all of the columns of the first plurality and second plurality of columns.

Other objects and advantages of the present invention should become apparent from an examination of the drawing and accompanying description.

In the drawing and accompanying description a preferred embodiment of the present invention is shown and described but it is to be understood that the drawing and accompanying description are for the purpose of illustration only and do not limit the invention and that the invention will be defined by the appended claims.

BRIEF DESCRIPTION OF THE DRAWING

The drawing is a perspective view of one preferred embodiment of gymnasium set which is made in accordance with the principles and teachings of the present invention.

DETAILED DESCRIPTION OF PREFERRED EMBODIMENTS

Referring to the drawing in detail, the numerals 10, 12, 14 and 16 denote columns of a first plurality of vertically-directed columns of tubular form. In one preferred embodiment of the present invention, those columns will be long enough so the upper ends thereof will be disposed approximately seven and one-half feet above the level of the ground when the lower ends thereof are solidly embedded within concrete in the ground. Those columns are made of twenty gauge or heavier galvanized steel. The numerals 18 and 24 denote L-shaped fittings which secure a length of tubing 26 to the upper ends of the columns 10 and 16. The numerals 20 and 22 denote T-shaped fittings which secure that length of tubing to the upper ends of the columns 12 and 14. The length of tubing 26 constitutes a horizontally-directed spacing and connecting member which interconnects the upper ends of the columns 10, 12, 14 and 16 and which holds those ends in fixedly spaced-apart relation.

The numerals 32, 34, 36 and 38 denote columns of a second plurality of vertically-directed columns of tubular form. In the said one preferred embodiment of the present invention, the upper ends of the columns 32, 34, 36 and 38 will be located approximately six feet above the level of the ground when the lower ends thereof are solidly embedded within concrete in the ground. Unlike the columns 10, 12, 14 and 16 which are aligned in a row, the columns 32, 34, 36 and 38 are disposed to define the corners of a square. However, the columns 32 and 34 are aligned with column 12, and the columns 36 and 38 are aligned with column 14.

The numeral 40 denotes an L-shaped fitting which secures one end of a length of tubing 44 to the upper end of the column 32; and the numeral 42 denotes fasteners which coact with a T-shaped fitting, not shown, to connect that length of tubing to the upper end of the column 34. The numeral 46 denotes a compressed, concave end of the length of tubing 44 which is secured to the column 12 by fasteners 48. As indicated particularly by the drawing, the end 46 of the length of tubing 44 is connected to the column 12 intermediate the upper end and the mid-portion of that column. The length of tubing 44 constitutes a second horizontally-directed spacing and connecting member; and it interconnects the upper ends of the columns 32 and 34 with each other and also with the column 12.

The numeral 50 denotes an L-shaped fitting which connects the upper end of the column 36 to one end of a length of tubing 54; and the numeral 52 denotes a T-shaped fitting which connects the upper end of the column 38 to that length of tubing. The numeral 56 denotes the compressed, concave other end of the length of tubing 54; and that compressed, concave end is fixedly secured to the column 14 at a point intermediate the upper end and the midpoint of that column. The length of tubing 54 constitutes a third horizontally-directed spacing and connecting member; and it interconnects the upper ends of the columns 36 and 38 with each other and also with the column 14. As shown by the drawing, the lengths of tubing 44 and 54 are parallel to each other, are at the same level, and have the same lengths.

The numeral 58 denotes five rung-like spacers that are fixedly secured to the lengths of tubing 44 and 54. Those rung-like spacers help hold those lengths of tubing in rigidly spaced-apart relation, and also constitute the rungs of a horizontally-directed exercise ladder.

The numerals 60 and 61 denote two rung-like spacers which are fixedly secured to the columns 32 and 36. The spacer 61 is located a short distance above the ground; and the spacer 60 is located a short distance above the level of the spacer 61. Both of those spacers are located intermediate the midpoints of columns 32 and 36 and the ground. The rung-like spacers 60 and 61 will serve as the rungs of a vertically-directed ladder to enable users of the gymnasium set to reach the left-handmost of the horizontally-directed rung-like spacers 58.

The numeral 62 denotes a combination chinning bar and spacer. That chinning bar has one end thereof fixedly secured to the column 36 between the midpoint and upper end of that column; and it has the other end thereof fixedly secured to the column 38 between the midpoint and upper end of that column. That combination chinning bar and spacer is located below the level of the length of tubing 54.

The columns 10 and 16 coact with the length of tubing 26 to stiffen and stabilize each other and the columns 12 and 14 against all horizontally-directed forces; but particularly stiffen and stabilize each other and the columns 12 and 14 against any horizontally-directed forces which are displaced less than ninety degrees from the axis of that length of tubing. The columns 32 and 34 coact with the length of tubing 44 to stiffen and stabilize each other and the column 12, and also coact with column 12 and the length of tubing 26 to stiffen and stabilize the columns 10, 14 and 16 against all horizontally-directed forces; but particularly stiffen and stabilize each other and the columns 10, 12, 14 and 16 against any horizontally-directed forces which are displaced less than ninety degrees from the axis of the length of tubing 44. The columns 36 and 38 coact with the length of tubing 54 to stiffen and stabilize each other and the column 14, and also coact with column 14 and the length of tubing 26 to stiffen and stabilize the columns 10, 12 and 16 against all horizontally-directed forces; but particularly stiffen and stabilize each other and the columns 10, 12, 14 and 16 against all horizontally-directed forces which are displaced less than ninety degrees from the axis of the length of tubing 54. The rung-like spacers 58, 60 and 61 and the combination chinning bar and spacer 62 coact with the lengths of tubing 44 and 54 to stiffen and stabilize the columns 12, 14, 32, 34, 36 and 38 and, via the length of tubing 26, the columns 10 and 16. As a result, the gymnasium set provided by the present invention can be very sturdy and rugged, can be exceptionally resistant to horizontally-directed forces, and yet can use columns and horizontally-directed spacing and connecting members made of light gauge metal. Specifically, the columns 32, 34, 36 and 38 and the horizontally-directed spacing and connecting members 26, 44 and 54, as well as the columns 10, 12, 14 and 16, can be made of twenty gauge galvanized steel.

The L-shaped fittings 18 and 24 are secured to the length of tubing 26 by bolt and nut combinations as indicated by the drawing. Similarly, those L-shaped fittings are secured, respectively, to the upper ends of the columns 10 and 16 by bolt and nut combinations. The L-shaped fitting 40 is secured to the length of tubing 44 and to the upper end of the column 32 by bolt and nut combinations; and the L-shaped fitting 50 is connected to the length of tubing 54 and to the upper end of the column 36 by nut and bolt combinations. The T-shaped fittings 20 and 22 are secured to the length of tubing 26 by nut and bolt combinations. Further, those T-shaped fittings are secured, respectively, to the upper ends of the columns 12 and 14 by nut and bolt combinations. The upper end of the column 38 is secured to the length of tubing 54 by the T-shaped fitting 52 and nut and bolt combinations. The fasteners 42 and 48 are parts of nut and bolt combinations. The compressed and concave end 56 of the length of tubing 54 is secured to the column 14 by nut and bolt combinations. The rung-like spacers 58, 60 and 61 are secured to the lengths of tubing 44 and 54 by nut and bolt combinations; and the combination chinning bar and spacer 62 is secured to the columns 36 and 38 by nut and bolt combinations. The overall result is that there is no looseness or "play" between any part of the gymnasium set and any adjacent part; and hence that gymnasium set is sturdy, rugged and solid.

A pair of eye-bolts 64 extend vertically through the length of tubing 26 intermediate the L-shaped fitting 18 and the T-shaped fitting 20. A further pair of eye-bolts 66 extend vertically through the length of tubing 26 intermediate the L-shaped fitting 24 and the T-shaped fitting 22. A trapeze 68 is secured to, and supported by, the eye-bolts 64; and two rings 72 are secured to, and supported by, the eye-bolts 66. A climbing rope 70 is secured to, and supported by, the portion of the length of tubing 26 which is intermediate the T-shaped fittings 20 and 22.

The trapeze 68 will swing in a plane which is parallel to a plane that is defined by columns 12, 32 and 34 and the length of tubing 44. As a result, that length of tubing and the columns 32 and 34 will stiffen and stabilize column 12, and via the length of tubing 26 also will stiffen and stabilize column 10 against horizontally-directed forces which will be applied to those columns as a heavy child swings on the trapeze 68. The rings 72 could, if desired, be used for swinging; and those rings would swing in a plane parallel to a plane that is defined by the length of tubing 54 and columns 14, 36 and 38. As a result, that length of tubing and the columns 36 and 38 will stabilize and stiffen column 14, and via the length of tubing 26 also will stiffen and stabilize column 16 against horizontally-directed forces which will be applied to those columns as a heavy child swings on the ring 72. All of this means that the interactions of the lengths of tubing 44 and 54 with the columns 12, 14, 32, 34, 36 and 38 provide stiffening and stabilizing of columns 12 and 14, and also of columns 10 and 16.

The numeral 74 denotes parallel bars which are L-shaped in side elevation. The numeral 76 denotes compressed concave ends of those bars that are fixedly secured to the columns 12 and 14 by nut and bolt combinations. Those ends are secured to those columns at points which are intermediate the ground and the midpoints of those columns. A combination foot and spacing bar 78 is secured to the bottoms of the parallel bars 74; and it will rest upon the ground. Stabilizing bars 80 incline upwardly and inwardly from the outer ends of the foot and spacing bar 78; and the upper ends of those bars are securely fastened to the vertically-directed portions of the parallel bars 74 by nut and bolt combinations. Those stabilizing bars stiffen and stabilize those parallel bars.

The combination foot and spacing bar 78 will coact with the stabilizing bars 80 to maintain a desired spacing between the outer ends of the parallel bars 74, and also will hold those outer ends fixedly spaced apart. The securement of the compressed and concave ends 76 of those parallel bars to the columns 12 and 14 will stiffen and stabilize those parallel bars, and also will hold the upper ends of those parallel bars fixedly spaced apart. As a result, those parallel bars will be able to support heavy children.

The spacing between the columns 32 and 34, and the spacing between the columns 36 and 38, are the same as the spacing between the columns 12 and 14. As a result, the parallel bars 74 can have their upper ends secured to, and fixedly supported by, columns 32 and 34 or by columns 36 and 38.

The numeral 82 denotes a balancing bar which has a foot 84 adjacent one end thereof that can rest upon the ground. The other end of that balancing bar has a U-shaped connector 86 which is fixedly secured to that other end, and also to the column 10, by nut and bolt combinations. The column 10 performs the dual functions of serving as a support for one end of the balancing bar 82 and of coacting with the columns 12, 14, 16, 32, 34, 36 and 38, the lengths of tubing 26, 44 and 54, the various L-shaped and T-shaped fittings, and rung-like connectors 58, 60 and 61, and the combination chinning bar and spacer 62 to constitute a rugged, sturdy and readily-assembled gymnasium set.

The numeral 88 denotes an exercise board which has feet 90; and one of those feet is shown in the drawing. That board closely resembles standard and usual exercise boards; but it has the upper end thereof equipped with hooks 92. Those hooks are shown resting upon, and being supported by, a spacer 94 which is secured to lower portions intermediate the top and bottom of said one column and extending to and being secured to one of said further four vertically-directed columns, a third horizontally-directed spacing and connecting member which is displaced from, but is parallel to, said second horizontally-directed spacing and connecting member, said third horizontally-directed spacing and connecting member being secured to a second of said first said four vertically-directed columns intermediate the top and bottom of said second column and extending to and being secured to a second of said further four vertically-directed columns, rung-like connectors which extend between and rigidly interconnect said second and said third horizontally-directed spacing and connecting members, whereby said one and said second of said first said four vertically-directed columns and said one and said second of said further four vertically-directed columns constitute end supports for an overhead horizontally-directed exercise ladder, a third and a fourth column of said first said four vertically-directed columns which act through said first horizontally-directed spacing and connecting member to provide lateral stability and stiffening for said one and said second of said first said four vertically-directed columns, a third of said further four vertically-directed columns which is connected to said second horizontally-directed spacing and connecting member to provide lateral stability and stiffening for said one column of said first said four vertically-directed columns and also to provide lateral stability and stiffening for said one column of said further four vertically-directed columns, and a fourth of said further four vertically-directed columns which is connected to said third horizontally-directed spacing and connecting member to provide lateral stability and stiffening for said second column of said first said four vertically-directed columns of columns 32 and 34 by bolt and nut combinations; and hence those columns and that spacer support the upper end of exercise board 88. As a result, the columns 32 and 34 perform the dual functions of serving as part of the support for the upper end of the exercise board 88 and of coacting with the columns 10, 12, 14, 16, 36 and 38, the lengths of tubing 26, 44 and 54, the various L-shaped and T-shaped fittings, the rung-like connectors 58, 60 and 61, and the combination chinning bar and spacer 62 to constitute a rugged, sturdy and readily-assembled gymnasium set.

If, for any reason, it became desirable to substitute T-shaped fittings for the L-shaped fittings 18 and 24, that substitution could be made. In that event, further lengths of tubing and further columns could subsequently receive support from those T-shaped fittings to increase the overall size of the gymnasium set.

One or more sets of parallel bars 74, the balancing bar 82, and the exercise board 88 can be marketed as parts of, or as subsequently purchased accessories for, the gymnasium set. Use of one or more sets of parallel bars, balancing bar, and exercise board will increase the kind and number of exercises which can be performed on the gymnasium set.

Whereas the drawing and accompanying description have shown a preferred embodiment of the present invention, it should be apparent to those skilled in the art that various changes may be made in the form of the invention without affecting the scope thereof.

What I claim is:

1. A supporting frame, for use by gymnasts, which comprises a first plurality of vertically-directed columns, a first horizontally-directed spacing and connecting member which interconnects the upper ends of said columns to hold said upper ends of said columns in fixed, spaced-apart relation, said columns having lower ends adapted to be held in fixed, spaced-apart relation by being secured to the ground or other supporting surface, a second plurality of vertically-directed columns which are displaced horizontally from said first plurality of vertically-directed columns, a second horizontally-directed spacing and connecting member which is displaced from said first horizontally-directed spacing and connecting member, said second horizontally-directed spacing and connecting member being secured to one of said first plurality of vertically-directed columns intermediate the top and bottom of said one column and extending to and being secured to one of said second plurality of vertically-directed columns, a third horizontally-directed spacing and connecting member which is displaced from said first horizontally-directed spacing and connecting member, said third horizontally-directed spacing and connecting member being secured to a second of said first plurality of vertically-directed columns intermediate the top and bottom of said second column and extending to and being secured to a second of said second plurality of vertically-directed columns, rung-like connectors which extend between and rigidly interconnect said second and said third horizontally-directed spacing and connecting members, whereby said one and said second of said first plurality of vertically-directed columns and said one and said second of said second plurality of vertically-directed columns constitute end support for an overhead horizontally-directed exercise ladder, said first plurality of vertically-directed columns including at least three vertically-directed columns, a third column of said first plurality of vertically-directed columns acting through said first horizontally-directed spacing and connecting member to provide lateral stability and stiffening for said one and said second of said first plurality of vertically-directed columns and also acting through said first horizontally-directed spacing and connecting member and through said one of said first plurality of vertically-directed columns and through said second horizontally-directed spacing and connecting member to provide lateral stability and stiffening for said one of said second plurality of vertically-directed columns, said third column of said first plurality of vertically-directed columns also acting through said first horizontally-directed spacing and connecting member and through said second of said first plurality of vertically-directed columns and through said third horizontally-directed spacing and connecting members to provide lateral stability and stiffening for said second of said second plurality of vertically-directed columns, said columns of said first plurality of vertically-directed columns being aligned in a row, said second horizontally-directed spacing and connecting member and said third horizontally-directed spacing and connecting member being substantially parallel to each other, a third of said second plurality of vertically-directed columns being intermediate, and being aligned with, said one of said first plurality of vertically-directed columns and said one of said second plurality of vertically-directed columns, said third of said second plurality of vertically-directed columns being secured to said second horizontally-directed spacing and connecting member, said third of said second plurality of vertically-directed columns acting through said second horizontally-directed spacing and connecting member to help provide lateral stability and stiffening for said one of said first plurality of vertically-directed columns and also for said one of said second plurality of vertically-directed columns, and a swinging support for a person that is supported by, but can swing relative to, that portion of said first horizontally-directed spacing and connecting member which is intermediate said second and said third columns of said first plurality of vertically-directed columns, said third column of said first plurality of vertically-directed columns being displaced from said second of said first plurality of vertically-directed columns a distance great enough to accommodate said swinging support for said person, said third horizontally-directed spacing and connecting member being substantially normal to said row of aligned columns of said first plurality of vertically-directed columns, whereby said swinging support for said person can swing in a plane which is parallel to a plane that is defined by said second of said first plurality of vertically-directed columns and by said second of said second plurality of vertically-directed columns and by said third horizontally-directed spacing and connecting member, whereby said second plurality of vertically-directed columns and said third horizontally-directed spacing and connecting member coact to help said second of said first plurality of vertically-directed columns resist the forces which will be applied to it when a person swings on said swinging support, and whereby said second plurality of vertically-directed columns and said second horizontally-directed spacing and connecting member and said one of said first plurality of vertically-directed columns and said first horizontally-directed spacing and connecting member coact to help said one of said first plurality of vertically-directed columns resist the forces which will be applied to it when a person swings on said swinging support, said swinging support for said person being movable through an arcuate path, said second of said first plurality of vertically-directed columns and said second of said second plurality of vertically-directed columns and said third horizontally-directed spacing and connecting member being located to one side of, and being laterally spaced away from, said arcuate path, said third column of said first column of said first plurality of vertically-directed columns being located at the opposite side of, and being laterally spaced away from, said arcuate path, said third column of said first plurality of vertically-directed columns being the only vertically-directed portion of said supporting frame which is at said opposite side of said path, all of the vertically-directed columns of said second plurality of vertically-directed columns being displaced substantial distances horizontally from said second column of said first plurality of vertically-directed columns to define a space which is devoid of vertically-directed columns, whereby both sides of said swinging path are substantially free of vertically-directed columns.

* * * * *